US009992831B1

(12) United States Patent
Tu et al.

(10) Patent No.: US 9,992,831 B1
(45) Date of Patent: Jun. 5, 2018

(54) BACKLIGHT DEVICE AND CONTROL METHOD THEREOF

(71) Applicant: AMTRAN TECHNOLOGY CO., LTD, New Taipei (TW)

(72) Inventors: Kai-Ti Tu, New Taipei (TW); Chih-Chieh Wang, New Taipei (TW)

(73) Assignee: AMTRAN TECHNOLOGY CO., LTD., New Taipei (TW)

( * ) Notice: Subject to any disclaimer, the term of this patent is extended or adjusted under 35 U.S.C. 154(b) by 0 days. days.

(21) Appl. No.: 15/583,894

(22) Filed: May 1, 2017

(30) Foreign Application Priority Data

Feb. 22, 2017 (TW) ..... 106106000 A

(51) Int. Cl.

| | |
|---|---|
| ***H05B 37/02*** | (2006.01) |
| ***H05B 33/08*** | (2006.01) |
| ***G09G 3/34*** | (2006.01) |
| ***G09G 5/10*** | (2006.01) |
| *G09G 3/36* | (2006.01) |

(52) U.S. Cl.

CPC ..... *H05B 33/0827* (2013.01); *G09G 5/10* (2013.01); *H05B 33/086* (2013.01); *H05B 33/0818* (2013.01); *H05B 33/0842* (2013.01); *H05B 33/0845* (2013.01); *H05B 33/0863* (2013.01); *G09G 3/3406* (2013.01); *G09G 3/36* (2013.01);

(Continued)

(58) Field of Classification Search

CPC ..... H05B 33/0827; H05B 33/0815; H05B 33/0824; H05B 33/0851; H05B 33/0857; H05B 37/02; H05B 33/083; H05B 33/0845; H05B 33/0848; G09G 3/3406; G09G 2320/064; G09G 2320/062; G09G 5/10; G09G 2320/0626; Y02B 20/347; Y02B 20/346

See application file for complete search history.

(56) References Cited

U.S. PATENT DOCUMENTS 7,605,550 B2 * 10/2009 Ferentz ..... H05B 33/0815 315/312
8,120,288 B2 * 2/2012 Liu ..... H05B 33/0818 315/297

(Continued)

FOREIGN PATENT DOCUMENTS

TW 201106792 A 2/2011

OTHER PUBLICATIONS

TW Office Action dated Apr. 20, 2017 in application No. 106106000.

*Primary Examiner* — Vibol Tan
(74) *Attorney, Agent, or Firm* — Maschoff Brennan

(57) ABSTRACT

A backlight device includes a number of light emitting strings, a number of switch units, a first control unit and a second control unit. Each of the light emitting strings includes a number of light emitting units connected in series. The light emitting strings are configured to be driven by electric power to emit light. One of the switch units serves as a reference switch unit. The first control unit is configured to adjust a voltage level of the control terminal of the reference switch unit according to a voltage level of the reference node. The second control unit is configured to instruct the first control unit to set the voltage levels of the control terminal of each of the switch units and the electric power according to pre-calibration data corresponding to the illumination type of the backlight device.

8 Claims, 3 Drawing Sheets

(52) U.S. Cl.
CPC ..... *G09G 2320/0646* (2013.01); *G09G 2330/021* (2013.01)

(56) References Cited

U.S. PATENT DOCUMENTS

| | | | | |
|---|---|---|---|---|
| 8,169,161 | B2 * | 5/2012 | Szczeszynski ..... | H05B 33/0815 315/185 R |
| 8,253,342 | B2 * | 8/2012 | Ku ..... | H05B 33/0827 315/185 R |
| 8,427,073 | B2 * | 4/2013 | Kung ..... | G09G 3/3406 315/193 |
| 9,468,055 | B2 * | 10/2016 | Cheng ..... | H05B 33/0818 |
| 2010/0283773 | A1 | 11/2010 | Kim | |
| 2013/0250215 | A1 | 9/2013 | Sasaki et al. | |
| 2017/0027037 | A1 * | 1/2017 | Sedzin ..... | H05B 33/0857 |

* cited by examiner

BACKLIGHT DEVICE AND CONTROL METHOD THEREOF

CROSS-REFERENCE TO RELATED APPLICATIONS

This non-provisional application claims priority under 35 U.S.C. § 119(a) on Patent Application No(s). 106106000 filed in Taiwan, R.O.C. Feb. 22, 2017, the entire contents of which are hereby incorporated by reference.

BACKGROUND

Technical Field

This disclosure relates to a backlight device and a control method thereof, and more particularly to a backlight device and a control method thereof supporting various illumination types.

Related Art

The backlight device is one of the key components of a liquid crystal display (LCD), which is used to supply sufficient and uniformly distributed light since liquid crystal is not luminous, thus the backlight device cooperating with a display panel is able to display an image. Nowadays, LCD panels are widely applied to monitors, laptops, digital cameras, cell phones, and other electronic products. Accordingly, there is a continuous growth in the demands of backlight devices and related components. However, because the specifications of panels in various sizes are advancing all the time, the developers of backlight devices need to constantly solve new problems.

Light emitting diodes (LEDs) usually serve as the light source of backlight devices. LEDs have high energy conversion efficiency, small volume, long longevity, and are now widely applied to various electronic products. As the light source of backlight devices, LEDs significantly decrease the energy consumption of the backlight devices.

However, in practice, different LEDs may have different luminous properties. Generally speaking, LEDs are classified into different levels according to the voltage drop level, brightness, or wavelength. Based on the levels of LEDs, the corresponding bin codes are respectively assigned to the LEDs, with the corresponding bin codes for the manufacturers as reference. In general, more than one level of components are used on a production line. In other words, the LEDs in the same backlight device may have identical bin codes, but the LEDs in different backlight devices may have distinct bin codes. Therefore, when driver circuits with the same specification are applied to different backlight devices to drive the LEDs, part of the other components in some of the backlight devices may suffer surplus voltage drop and get over-heated.

SUMMARY

According to one or more embodiments of this disclosure, a backlight device is configured to be switched among a number of illumination types to correspondingly generate light. Each illumination type corresponds to a standard voltage range. The backlight device includes a number of light emitting strings, a number of switch units, a first control unit and a second control unit. Each light emitting strings includes a number of light emitting units having a series connection. The light emitting strings is configured to be driven by electric power to emit light. The switch units are respectively and electrically connected to the light emitting strings, and each switch unit has a control terminal. One of the switch units serves as a reference switch unit. The first control unit is electrically connected to the control terminal of each switch unit and a reference node. The first control unit is configured to adjust a voltage level of the control terminal of the reference switch unit according to a voltage level of the reference node. The first control unit is also configured to generate a pre-calibration data corresponding to one of the illumination types according to the voltage level of the control terminal of the reference switch unit and a voltage level of the electric power when the voltage level of the reference node falls into the standard voltage range corresponding to said one of the illumination types. The second control unit is electrically connected to the first control unit. When the backlight device is switched to one of the illumination types, the second control unit is configured to instruct the first control unit to set the voltage level of the control terminal of each switch unit and the voltage level of the electric power according to the corresponding pre-calibration data of current illumination type.

According to one or more embodiments of this disclosure, a control method of a backlight device is for controlling the backlight device configured to switch among a number of illumination types. The backlight device includes a number of light emitting strings and a number of switch units. The light emitting strings are driven by electric power to emit light. The switch units are respectively and electrically connected to the light emitting strings. The control method of the backlight device includes: adjusting a voltage level of a control terminal of a selected one of the switch units according to a voltage level of a reference node, with the selected switch unit serving as a reference switch unit; when the voltage level of the reference node falls into the standard voltage range corresponding to one of the illumination types, generating a pre-calibration data corresponding to said one of the illumination types according to the voltage level of the control terminal of the reference switch unit and the voltage level of the electric power; and when the backlight device is switched to one of the illumination types, setting the voltage level of the control terminal of each of the switch units and the voltage level of the electric power according to the corresponding pre-calibration data of current illumination type.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
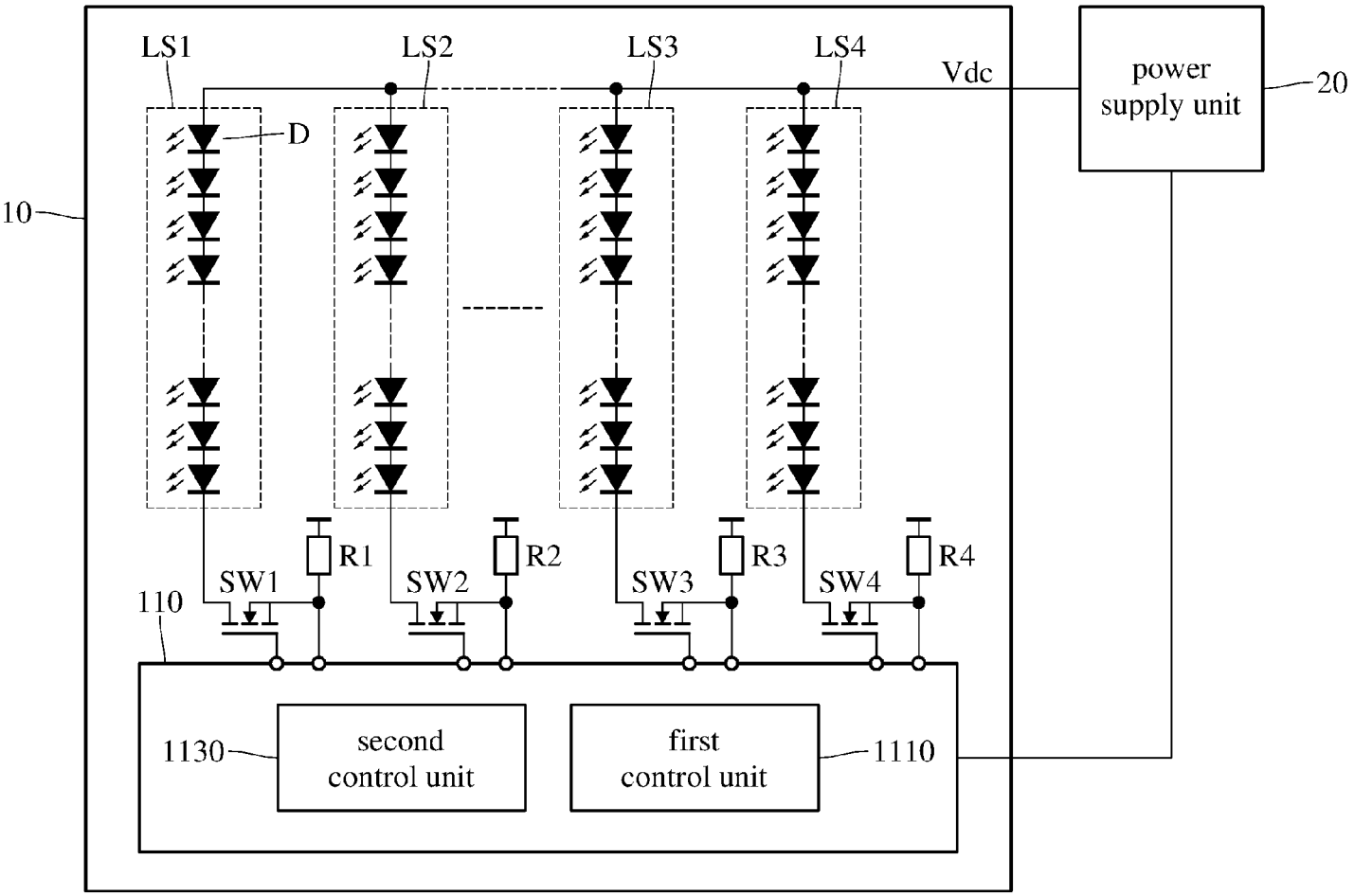
FIG. 1 is a schematic diagram of a circuit of a backlight device in an embodiment of this disclosure.

Please refer to FIG. 1. FIG. 1 is a schematic diagram of a circuit of a backlight device in an embodiment of this disclosure. A backlight device 10 is switched among a number of illumination types to correspondingly generate light. More specifically, the backlight device 10 is, for example, to be disposed in a liquid crystal display (not shown in FIG. 1) and adapted to provide light to a display panel (not shown in FIG. 1) of the liquid crystal display. The illumination types include a normal type and a high dynamic range (HDR) type for example. In the normal type, the display provides a normal image so that the backlight device correspondingly generates light with normal brightness. In the HDR type, the display is configured to provide a high dynamic range image which has an exposure dynamic range larger than that of the normal image. Therefore, the backlight device relatively provides light with brightness higher than that of the light supplied in the normal type. Said normal type and HDR type are defined relatively, and a person having ordinary skill in the art is able to define the related details of said two types according to the specification of the present disclosure. Moreover, the illumination types of the display or the backlight device 10 are not limited to said normal and HDR types.

The backlight device 10 includes a plurality of light emitting strings, a plurality of switch units and a control module 110. Herein, the light emitting strings LS1-LS4 and the switch units SW1-SW4 are exemplified. The switch units SW1-SW4 are, for example, N-type metal-oxide-semiconductor filed-effect transistors (MOSFET). The control module 110 includes a first control unit 1110 and a second control unit 1130. The amounts of the light emitting strings and the switch units are not limited to the figures and the specification of this disclosure. The switch unit can also be a P-type MOSFET, a depletion type MOSFET or other semiconductor unit which can serve as a switch. The first control unit 1110 and the second control unit 1130 can be two individual circuits or be integrated into a single circuit. The above description is merely exemplified and this disclosure is not limited to it.

The light emitting strings LS1-LS4 are driven by an electric power to emit light. Each of the light emitting strings includes a plurality of light emitting units D serially connects with one another. The amount of the light emitting units D is not limited to the figures and the specification of this disclosure. For example, the light emitting unit D is a light emitting diode (LED) such as a micro light emitting diode (μLED) or a quantum dots light emitting diode (QLED). In this embodiment, the electric power driving the light emitting strings LS1-LS4 to emit light is provided by a power supply unit 20. The power supply unit 20 is selectively disposed in the backlight device 10. The power supply unit 20 can be designed independently of the backlight device 10. In another embodiment, the backlight device 10 includes the power supply unit 20; namely, the control module 110, the light emitting strings, the switch units and the power supply unit 20 are integrated.

Each switch unit is electrically connected to a respective one of the light emitting strings. For example, the switch unit SW1 is electrically connected to the light emitting strings LS1, the switch unit SW2 is electrically connected to the light emitting strings LS2, and so on. At least one of the switch units SW1-SW4 is defined as at least one reference switch, which will be further illustrated later.

The control module 110 is electrically connected to the control terminals of the switch units SW1-SW4 and a reference node (not shown in FIG. 1). More specifically, the first control unit 1110 is electrically connected to the control terminals of the switch units SW1-SW4 and the reference node, and the second control unit 1130 is electrically connect to the first control unit 1110. For example, the first control unit 1110 and the second control unit 1130 are microcontrollers, central processing units (CPU) or application-specific integrated circuits (ASIC). Otherwise, as aforementioned, the first control unit 1110 and the second control unit 1130 can be integrated into a single microcontroller, CPU or ASIC. Any node in the circuit configuration of the backlight device 10 can serve as the reference node. In an embodiment, a terminal of one of the switch units SW1-SW4 or a terminal of the light emitting strings serves as the reference node. The related details are described later.

In this embodiment, the first control unit 1110 is a light emitting diode driver integrated circuit (LED driver IC), the second control unit 1130 is an integrated circuit of the backlight device 10 for example. The second control unit 1130 instructs the first control unit 1110 via a serial peripheral interface bus (SPI) or an inter-integrated circuit (I2C) for example. Thereby, the second control unit 1130 is capable of instructing the first control unit 1110 to drive the LED to selectively emit light.

As described before, the backlight device 10 is switched among various illumination types. The second control unit 1130 instructs the first control unit 1110 to set voltage levels of at least part of nodes. Said voltage levels correspond to different illumination types, so that the light emitting strings are driven to emit light accordingly. Taking the previous illustrated normal type and HDR type as examples, in said normal type, the second control unit 1130 instructs the first control unit 1110 to control the conduction status of the switch units SW1-SW4 or to control the power supply unit 20, in order to respectively adjust the current values of the driven currents passing through the light emitting strings LS1-LS4 to fall into a first standard current range. On the other hand, in said HDR type, the second control unit 1130 instructs the first control unit 1110 to control the conduction status of the switch units SW1-SW4 or to control the power supply unit 20, in order to respectively adjust the current values of driven currents passing through the light emitting strings LS1-LS4 to fall into a second standard current range. Current values in the second standard current range are higher than current values in the first standard current range, so that the current driving the light emitting strings LS1-LS4 in the HDR type is higher than that in the normal type. Therefore, in the HDR type, the backlight device 10 is capable of providing light with higher brightness.

In practice, the first standard current range and the second standard current range can be further narrowed to a first current value and a second current value higher than the first current value. In this embodiment, in the normal type, the second control unit 1130 instructs the first control unit 1110 to control the conduction status of the switch units SW1-SW4 or to control the power supply unit 20, in order to respectively adjust the current values of the driven currents passing through the light emitting strings LS1-LS4 to be equal to the first current value. In the HDR type, the second control unit 1130 instructs the first control unit 1110 to control the conduction status of the switch units SW1-SW4 or to control the power supply unit 20, in order to respectively adjust the current values of driven currents passing through the light emitting strings LS1-LS4 to be equal to the second current value.

As a more specific example, the backlight device 10 has an operation mode and a pre-calibration mode. In practice, an approach to switching between the operation mode and the pre-calibration mode is preset in the control module 110. By said approach, a user or a manufacturer is able to make the backlight device 10 enter the pre-calibration mode or the operation mode. In the operation mode of the backlight device 10, when the backlight device 10 is switched to one of the illumination types, the second control unit 1130 instructs the first control unit 1110 to set the voltage levels of the control terminals of the switch units SW1-SW4 and the voltage level Vdc of the electric power according to a set of pre-calibration data corresponding to the current illumination type (i.e. said one of the illumination types). Particularly, the normal type corresponds to one set of pre-calibration data, and the HDR type corresponds to another set of pre-calibration data. When the backlight device 10 is switched to the normal type, the second control unit 1130 instructs the first control unit 1110 to set the voltage levels of the control terminals of the switch units SW1-SW4 and the voltage level Vdc of the electric power according to the pre-calibration data corresponding to the normal type. In this situation, the power supply unit 20 provides the light emitting strings LS1-LS4 with the driven currents of which the current values are equal to said first current value. Therefore, the backlight device 10 is capable of providing light matching a normal image. When the backlight device 10 is switched to the HDR type, the second control unit 1130 instructs the first control unit 1110 to set the voltage levels of the control terminals of the switch units SW1-SW4 and the voltage level Vdc of the electric power according to the pre-calibration data corresponding to the HDR type. In this situation, the power supply unit 20 provides the light emitting strings LS1-LS4 with the driven currents of which the current values are equal to said second current value. Therefore, the backlight device 10 is capable of providing light matching a HDR image.

In the pre-calibration mode of the backlight device 10, the first control unit 1110 is configured for obtaining the pre-calibration data. In an embodiment, at least one of the switch units SW1-SW4 serves as at least one reference switch unit; namely, one, more or all switch units SW1-SW4 may be the at least one reference switch unit. The first control unit 1110 adjusts the voltage level of the control terminal of the reference switch unit according to the voltage level of the reference node. In practice, each illumination type corresponds to a standard voltage level or a standard voltage range. When the voltage level of the reference node is substantially equal to the standard voltage level or falls into the standard voltage range corresponding to one of the illumination types, the first control unit 1110 generates the pre-calibration data corresponding to said one of the illumination types according to the voltage level of the control terminal of the reference switch unit and the voltage level of the electric power.

Figure 2:
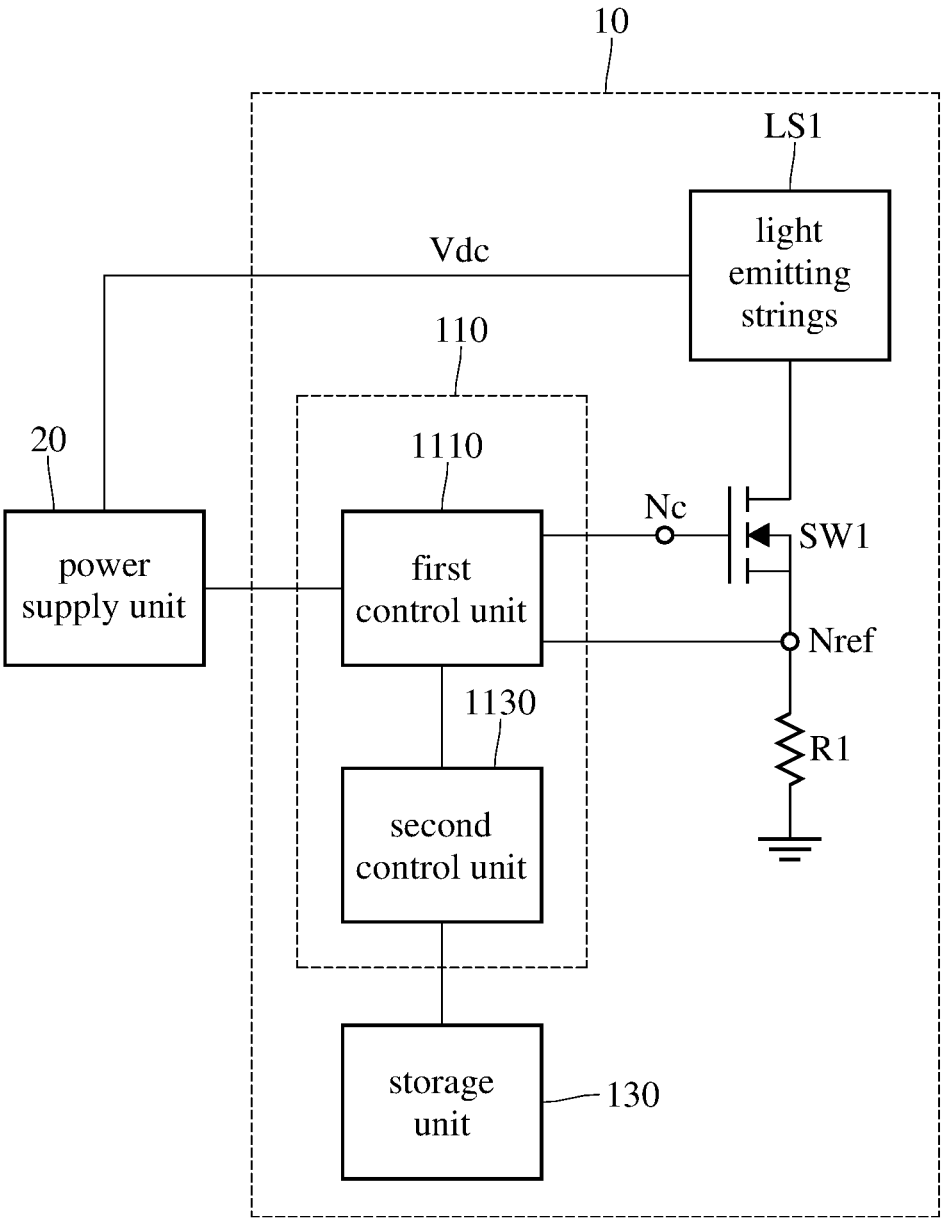
FIG. 2 is a functional block diagram of part of components of a backlight device in an embodiment of this disclosure.

Please refer to FIG. 2, which is for a further illustration of the operation of the backlight device. FIG. 2 is a functional block diagram of part of components of a backlight device in an embodiment of this disclosure. In the embodiment as shown in FIG. 2, the switch unit SW1 serves as the reference switch unit. For a concise explanation, merely the light emitting strings LS1 and the switch unit SW1 are illustrated in FIG. 2. The first terminal of the switch unit SW1 is electrically connected to the light emitting strings LS1, and the second terminal of the switch unit SW1 is connected to ground (reference voltage terminal) via a resistor R1. The first control unit 1110 is respectively and electrically connected to the second terminal and the control terminal of the switch unit SW1. Besides, the first control unit 1110 is electrically connected to the power supply unit 20. The second control unit 1130 is electrically connected to the first control unit 1110. In the embodiment as shown in FIG. 2, the second terminal of the switch unit SW1 serves as the reference node Nref. Moreover, the reference node Nref has a voltage level Vref, and the control terminal Nc of the switch unit SW1 has a voltage level Vc. These labels are for convenience of later explanation.

In the pre-calibration mode, the first control unit 1110 generates the pre-calibration data corresponding to various illumination types. For example, the backlight device 10 adjusts the voltage level Vc to control the conduction status of the switch unit SW1 in order to make the current value of the driven current approach the first current value related to the normal type, with the driven current passing through the light emitting strings LS1. In an embodiment, the first control unit 1110 obtains the current value of the driven current according to the voltage level Vref and the resistance of the resistor R1, and then determines whether the current value of the driven current is substantially equal to the first current. When the first control unit 1110 determines that the driven current is substantially equal to the first current value, the first control unit 1110 generates the pre-calibration data related to the normal type according to the voltage level Vdc of the electric power and the voltage level Vc. In an embodiment, the pre-calibration data of the normal type includes the voltage level Vdc and the voltage level Vc in the normal type. In another embodiment, the first control unit 1110 further processes (converses) the voltage level Vdc and the voltage level Vc in the normal type to generate the pre-calibration data of the normal type.

Similarly, the backlight device 10 adjusts the voltage level Vc in order to make the driven current approach the aforementioned second current value corresponding to the HDR type, with the driven current passing through the light emitting strings LS1. When the first control unit 1110 determines that the driven current is substantially equal to the aforementioned second current, the first control unit 1110 generated the pre-calibration data corresponding to the HDR type according to the voltage level Vdc and the voltage level Vc. In an embodiment, the pre-calibration data corresponding to the HDR type includes the voltage level Vdc and the voltage level Vc in the HDR type. In another embodiment, the first control unit 1110 further processes (converses) the voltage level Vdc and the voltage level Vc in the HDR type to generate the pre-calibration data of the HDR type In the above embodiment, the switch unit SW1 is exemplified to serve as the reference switch unit. In another embodiment, both the switch unit SW1 and the switch unit SW2 serve as reference switch units. In this situation, the pre-calibration data of every illumination type relates to the voltage level Vdc of the electric power, the voltage level of the control terminal of the switch unit SW1 and the voltage level of the control terminal of the switch unit SW2. More specifically, when more than one of the switch units SW1-SW2 serve as reference switch units, the first control unit 1110 is capable of calculating a average or a weighted average of the voltage levels of the control terminals of the reference switch units, or processing these voltage level by other kind of calculation, in order to generate an adequate voltage level for the control terminals of all of the switch units SW1-SW4. The pre-calibration data of each illumination type includes said adequate voltage level of the control terminals.

In yet another embodiment, all of the switch units SW1-SW4 serve as reference switch units. In this situation, the pre-calibration data of each illumination type includes the voltage level Vdc of the electric power and the voltage levels of the control terminals of the switch units SW1-SW4. In other words, when all the switch units serve as the reference switch units, the pre-calibration data of each illumination type includes the voltage levels of the control terminals of all the switch units.

In the embodiment as shown in FIG. 2, the backlight device 10 further includes a storage unit 130. The storage unit 130 stores the pre-calibration data. In other words, in the operation mode, when the backlight device 10 is switched to one of the illumination types, the second control unit 1130 is capable of reading out the pre-calibration data corresponding to said one of the illumination types from the storage unit 130. The pre-calibration data indicates the ideal voltage level of the control terminal of the switch unit SW1 and the ideal voltage level of the electric power in said one of the illumination types. Therefore, the first control unit 1110 is capable of setting the voltage level Vc and the voltage level Vdc according to the pre-calibration data. In another embodiment, when the switch units SW1-SW4 all serves as the reference switch units, the second control unit 1130 is capable of reading out the pre-calibration data from the storage unit 130, with the pre-calibration data indicating the ideal voltage levels of the control terminals of the switch units SW1-SW4 and the ideal voltage level of the electric power. Therefore, the first control unit 1110 is capable of setting the voltage levels of the control terminals of the switch units SW1-SW4 and the electric power.

However, in an embodiment, when the first control unit 1110 cannot make the current value of the driven current approach the first current value or the second current value by adjusting the voltage level Vc merely, the first control unit 1110 adjusts the voltage level Vdc of the electric power besides the voltage level Vc, so that the current value of the driven current may be adjusted by a wider margin. Therefore, the pre-calibration of various illumination types may be obtained successfully.

In a comparative embodiment, if a LED component with a first bin code serves as the aforementioned light emitting units of the backlight devices in the first shipment on a production line, a voltage drop of each light emitting strings of the backlight devices has to be 81.6 volt (V) in order to emit light corresponding to the HDR type during operation in the HDR type. Besides, a voltage drop of each light emitting string has to be 74.4 V during operation in the normal type. When a conventional method for supplying power is applied to the backlight device, the power supply unit is set to supply electric power of 81.6 V in the HDR type, and to supply electric power of 74.4 V in the normal type. Moreover, by a conventional method for manufacture, the same power supply units are applied to the backlight devices of different batches. In the above situation, if a LED component with a first bin code serves as the light emitting units of the backlight devices in the second batch, each light emitting strings needs a voltage drop of 74.4 V during operation in the HDR type, and needs a voltage drop of 67.2 V during operation in the normal type. When the conventional method for power supply is applied, in the same manner, the power supply unit of the backlight device is set to supply electric power of 81.6 V in the HDR type, and to supply electric power of 74.4 V in the normal type. As a result, in the second shipment, when the backlight device is switched to the HDR type, each of its switch units has to take a voltage drop of 7.2 V (i.e. 81.6 V minus 74.4 V). Furthermore, when the backlight device is switched to the normal type, each of its switch units has to take a voltage drop of 7.2 V (i.e. 74.4 V minus 67.2 V). It causes a serious overheating problem.

In practice, the power supply unit is commonly designed based on the maximum voltage drop which the light emitting strings may need to emit light. Accordingly, if the electric power supplied by the power supply unit is higher than the voltage drop necessary for the operation of the light emitting strings of the backlight device, the switch unit serially connecting with the light emitting strings would suffer the surplus voltage drop and generate heat. The above approach ensures that the backlight device provides the required light, but it can easily cause the damages of the components of the backlight device or even danger.

Compared to the above comparative embodiment, in an embodiment of this disclosure, with respect to generating the pre-calibration of the HDR type, the power supply unit 20 supplies an electric power with a preset voltage level, and then the first control unit 1110 sets the voltage level Vc as the preset voltage level to conduct the switch unit SW1. For example, the preset voltage level is set as the voltage drop which is necessary to the light emitting strings of the LED component with the first bin code in the normal type. According to the aforementioned embodiment, the voltage level Vdc is 74.4 V at this time. Afterwards, the first control unit 1110 adjusts the voltage level Vc or the voltage level Vdc step by step, in order to obtain the pre-calibration data of the HDR type.

More specifically, the first control unit 1110 determines whether the driven current passing through the light emitting strings fulfills a current specification of the HDR type. As mentioned before, the first control unit 1110 obtains the driven current according to the voltage level of the reference node Nref and the resistance of the resistor R1. When the first control unit 1110 determines that the driven current is too low, the first control unit 1110 increases the voltage level Vc, and then determines whether the driven current fulfills the current specification of the HDR type again. If the voltage level Vc is increased to a preset upper limit but the driven current have not fulfilled the current specification, the first control unit 1110 instructs the power supply unit 20 to increase the voltage level Vdc to make the voltage level Vdc higher than 74.4 V. Afterwards, the first control unit 1110 selectively adjusts the voltage level Vc or the voltage level Vdc according to the voltage level of the reference node Nref until the driven current fulfills the current specification of the HDR type.

On the contrary, the preset voltage level is set as the voltage drop which the light emitting strings of the LED component with the first bin code needs in the HDR type. According to the aforementioned embodiment, the voltage level Vdc is 81.6 V at this time. Afterwards, the first control unit 1110 determines whether the driven current passing through the light emitting strings fulfills a current specification of the normal type. When the first control unit 1110 determines that the driven current is too high, the first control unit 1110 decreases the voltage level Vc, and then determines whether the driven current fulfills the current specification of the normal type again. If the voltage level Vc is decreased to a preset lower limit but the driven current does still not fulfill the current specification of the normal type, the first control unit 1110 instructs the power supply unit 20 to decrease the voltage level Vdc to make the voltage level Vdc lower than 81.6 V. The first control unit 1110 then adjust the voltage level Vc or the voltage level Vdc according to the voltage level Vref until the driven current fulfills the current specification of the normal type.

The method for obtaining the pre-calibration data of the HDR type and that of the normal type are exemplified in the above statement. A person having ordinary skill in the art is able to know how to obtain pre-calibration data of another illumination type according to the above statement, so the related details are not repeated. In the pre-calibration mode as aforementioned, the current value of the driven current is adjusted by adjusting the voltage level of the control terminal of the switch unit, or simultaneously adjusting the voltage level of the electric power, in order to decrease the voltage drop of the switch unit. Moreover, the first control unit generates the pre-calibration data according to the adjusted voltage level of the control terminal of the switch unit and the adjusted voltage level of the electric power for follow-up use. The actual values of the aforementioned voltages and currents and the specifications of the illumination types are not limited in this disclosure, and can be designed by a person having ordinary skill in the art according to the specification of this disclosure.

Figure 3:
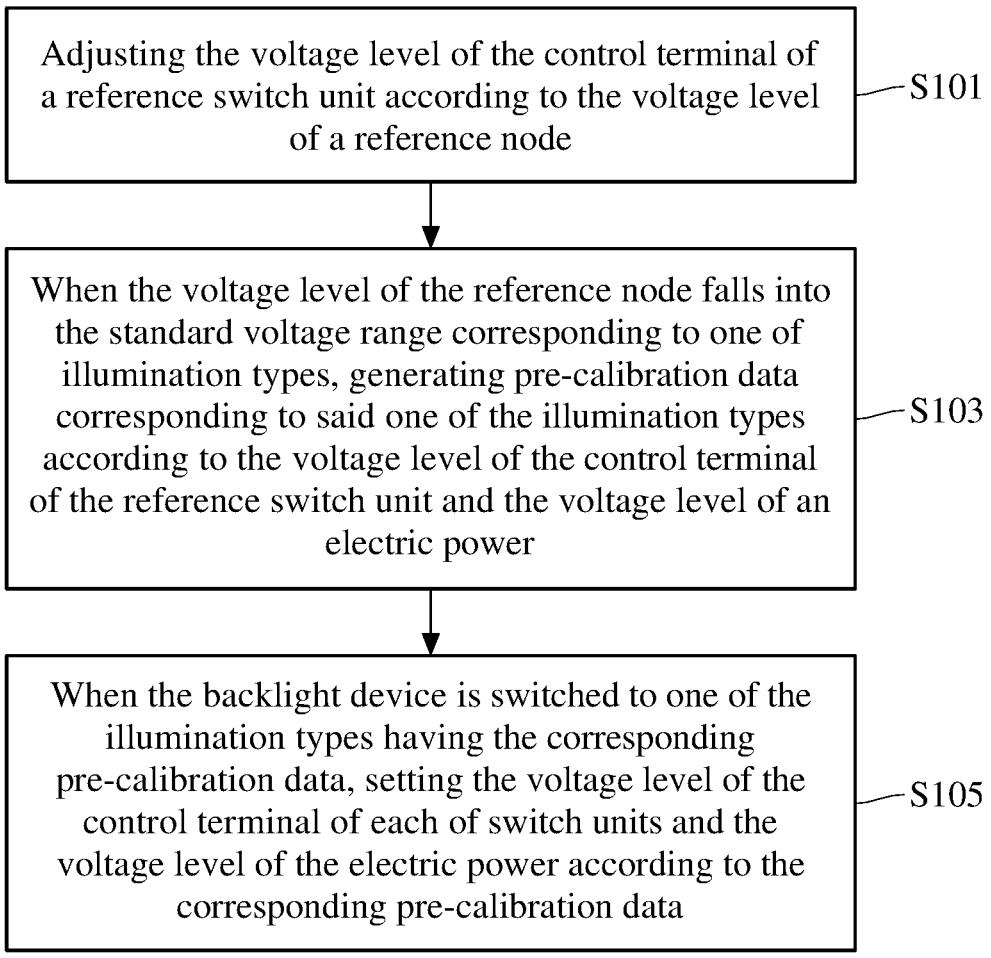
FIG. 3 is a flowchart of a control method of a backlight device in an embodiment of this disclosure.

According to the above description, this disclosure further provides a control method of the backlight device. Please refer to FIG. 3. FIG. 3 is a flowchart of a control method of a backlight device in an embodiment of this disclosure. Said backlight device is configured to being switched among a number of illumination types. The backlight device has a number of light emitting strings and a number of switch units. The light emitting strings are driven by electric power to emit light. The switch units are respectively connected to the light emitting strings. In step S101, the voltage level of the control terminal of the reference switch unit is adjusted according to the voltage level of the reference node in the pre-calibration mode of the backlight device. In step S103, when the voltage level of the reference node falls into the standard current range of one of the illumination types, the pre-calibration data corresponding to said one of the illumination types is generated according to the voltage level of the control terminal of the reference switch unit and the voltage level of the electric level. In step S105, when the backlight device is switched to one of the illumination types having the corresponding pre-calibration data, the voltage levels of the control terminals of the switch units are set according to the corresponding pre-calibration data of said one of the illumination type.

In view of the above description, this disclosure provides a backlight device and a control method thereof. By setting a voltage level of a control terminal of one or more switch units and a voltage level of an electric power according to an illumination type and pre-calibration data, an over high voltage drop may be avoided as the backlight device providing light with consistent brightness. Accordingly, there is no need to add an extra heat dissipating component to the backlight device or to increase the dissipating area of a circuit board of the backlight device. Moreover, there is no need to limit the backlight devices in each shipment to including light emitting components in the same type. As a result, the production cost is decreased substantially.

Said pre-calibration data is related to a voltage level of part of nodes of the backlight device in a pre-calibration mode. In the pre-calibration mode, the pre-calibration data respectively corresponding to various illumination types is obtained by a method similar to closed-loop method. When the backlight device is switched among the illumination types, the backlight device is capable of precisely controlling voltage levels of the related nodes and driven currents of light emitting strings. Moreover, in an embodiment, by storing the pre-calibration data in advance, the backlight device is capable of rapidly setting the voltage levels of the related nodes in the operation mode. Therefore, besides overcoming the aforementioned issue caused by the LED components with different bin codes, the backlight device and the control method thereof of this disclosure may also increase a control speed and reduce complexity of hardware.

What is claimed is:

1. A backlight device, configured to be switched among a plurality of illumination types to correspondingly generate light, with each of the plurality of illumination types corresponding to a standard voltage range, and the backlight device comprising:

a plurality of light emitting strings configured to be driven by electric power to emit light, with each of the plurality of light emitting strings comprising a plurality of light emitting units;

a plurality of switch units respectively and electrically connected to the plurality of light emitting strings, with each of the plurality of switch units having a control terminal and with one of the plurality of switch units serving as a reference switch unit;

a first control unit electrically connected to the control terminal of each of the plurality of switch units and a reference node, with the first control unit configured to adjust a voltage level of the control terminal of the reference switch unit according to a voltage level of the reference node, and to generate pre-calibration data corresponding to one of the plurality of illumination types according to the voltage level of the control terminal of the reference switch unit and a voltage level of the electric power when the voltage level of the reference node falls into the standard voltage range corresponding to said one of the plurality of illumination types; and a second control unit electrically connected to the first control unit, and when the backlight device is switched to one of the plurality of illumination types, the second control unit configured to instruct the first control unit to set the voltage level of the control terminal of each of the plurality of switch units and the voltage level of the electric power according to the corresponding pre-calibration data of current illumination type;

wherein the pre-calibration data corresponding to one of the plurality of illumination types comprises the voltage level of the electric power and the voltage level of the control terminal of the reference switch unit, with the voltage levels of the electric power and the control terminal of the reference switch unit obtained when the voltage level of the reference node falls into the standard voltage range corresponding to the illumination type.

2. The backlight device according to claim 1, wherein the first control unit further adjusts the voltage level of the electric power according to the voltage level of the reference node, and when the voltage level of the reference node falls into the standard voltage range corresponding to one of the plurality of illumination types, the first control unit generates the pre-calibration data corresponding to the illumination type according to the voltage level of the control terminal of the reference switch unit and the voltage level of the electric power.

3. The backlight device according to claim 1, wherein the reference switch unit comprises a first terminal, a second terminal and the control terminal, with the first terminal electrically connected to one of the plurality of light emitting strings, and the second terminal being the reference node.

4. The backlight device according to claim 3, further comprising a plurality of resistors, with each of the plurality of resistors has a series connection between a respective one of the second terminals of the plurality of switch units and a reference voltage terminal.

5. The backlight device according to claim 1, further comprising a power supply unit electrically connected to the first control unit, and configured to supply the electric power and to selectively adjust the voltage level of the electric power according to an instruction from the first control unit.

6. The backlight device according to claim 1, further comprising a storage unit electrically connected to the second control unit, and configured to store the pre-calibration data.

7. A control method of a backlight device, for controlling the backlight device configured to switch among a plurality of illumination types and comprising a plurality of light emitting strings and a plurality of switch units, with each of the plurality of illumination types corresponding to a standard voltage range, the plurality of light emitting strings configured to be driven by electric power to emit light, the plurality of switch units respectively and electrically connected to the plurality of light emitting strings, and the control method comprising:

adjusting a voltage level of a control terminal of a selected one of the plurality of switch units according to a voltage level of a reference node, with the selected switch unit serving as a reference switch unit;

when the voltage level of the reference node falls into the standard voltage range corresponding to one of the plurality of illumination types, generating pre-calibration data corresponding to said one of the plurality of illumination types according to the voltage level of the control terminal of the reference switch unit and the voltage level of the electric power; and when the backlight device is switched to one of the plurality of illumination types, setting the voltage level of the control terminal of each of the plurality of switch units and the voltage level of the electric power according to the corresponding pre-calibration data of current illumination type;

wherein the pre-calibration data corresponding to one of the plurality of illumination types comprises the voltage level of the electric power and the voltage level of the control terminal of the reference switch unit, with the voltage levels of the electric power and the control terminal of the reference switch unit obtained when the voltage level of the reference node falls into the standard voltage range corresponding to the illumination type.

8. The control method according to claim 7, further comprising:

adjusting the voltage level of the electric power according to the voltage level of the reference node; and generating a pre-calibration data corresponding to one of the plurality of illumination types according to the voltage level of the control terminal of the reference switch unit and a voltage level of the electric power when the voltage level of the reference node falls into the standard voltage range corresponding to said one of the plurality of illumination types.

* * * * *